US011442480B2

(12) United States Patent
Yoshioka et al.

(10) Patent No.: US 11,442,480 B2
(45) Date of Patent: Sep. 13, 2022

(54) POWER SUPPLY CIRCUIT ALTERNATELY SWITCHING BETWEEN NORMAL OPERATION AND SLEEP OPERATION

(71) Applicant: LAPIS Semiconductor Co., Ltd., Yokohama (JP)

(72) Inventors: Toru Yoshioka, Yokohama (JP); Yoichi Fueki, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 16/823,305

(22) Filed: Mar. 18, 2020

(65) Prior Publication Data

US 2020/0310476 A1 Oct. 1, 2020

(30) Foreign Application Priority Data

Mar. 28, 2019 (JP) ..... JP2019-064415

(51) Int. Cl.
*G05F 1/563* (2006.01)
*G05F 1/59* (2006.01)
*G05F 1/575* (2006.01)

(52) U.S. Cl.
CPC ..... *G05F 1/563* (2013.01); *G05F 1/575* (2013.01); *G05F 1/59* (2013.01)

(58) Field of Classification Search
CPC ..... H02H 3/08; H02H 3/025; H02H 3/00; H02H 3/001; H02H 3/002; H02H 3/005; H02H 3/008; H02H 3/02; H02H 3/021; H02H 3/023; H02H 3/026; H02H 3/028; G05F 1/573; G05F 1/5735; G05F 1/462; G05F 1/465; G05F 1/468; G05F 1/56; G05F 1/575; G05F 1/562; G05F 1/565; G05F 1/567; G05F 1/569; G05F 1/571; G05F 1/59; G05F 1/563
See application file for complete search history.

(56) References Cited

U.S. PATENT DOCUMENTS 6,150,798 A * 11/2000 Ferry ..... H02M 3/158 323/273
6,229,289 B1 * 5/2001 Piovaccari ..... H02M 3/1588 323/268
6,236,194 B1 * 5/2001 Manabe ..... G05F 1/565 323/274
6,674,274 B2 * 1/2004 Hobrecht ..... H02M 3/1584 323/285
7,193,399 B2 * 3/2007 Aikawa ..... G05F 1/565 323/282
7,253,596 B2 * 8/2007 Yamamoto ..... H02M 3/1588 323/281

(Continued)

FOREIGN PATENT DOCUMENTS

JP 2001147746 5/2001

*Primary Examiner* — Thienvu V Tran
*Assistant Examiner* — Nusrat Quddus
(74) *Attorney, Agent, or Firm* — JCIPRNET

(57) ABSTRACT

A power supply circuit in which an increase in a leakage current can be suppressed is provided. In a power supply circuit in which a main LDO unit outputs a first internal voltage during a normal operation and a sub LDO unit outputs a sleep voltage during a sleep operation, the sleep voltage is applied to a drain of a transistor, and an external voltage higher than the sleep voltage is applied to a gate and a back gate thereof.

2 Claims, 4 Drawing Sheets

(56) References Cited

U.S. PATENT DOCUMENTS 7,276,887 B2 * 10/2007 Miki ..... G11C 5/147 323/269
7,554,305 B2 * 6/2009 Nunokawa ..... G05F 1/575 323/273
7,808,220 B2 * 10/2010 Rader ..... H02M 3/07 323/268
7,847,530 B2 * 12/2010 Takagi ..... G05F 1/56 323/280
8,129,966 B2 * 3/2012 Takagi ..... G05F 1/575 323/280
9,535,437 B1 * 1/2017 Dwelley ..... H04L 41/0681
9,837,896 B1 * 12/2017 Amei ..... H02M 1/32
9,939,830 B1 * 4/2018 Lee ..... G05F 1/563
10,001,794 B2 * 6/2018 Olejarz ..... G05F 1/56
10,386,877 B1 * 8/2019 Magen ..... G05F 1/575
2002/0121882 A1 * 9/2002 Matsuo ..... G05F 1/565 323/266
2002/0126512 A1 * 9/2002 Nakagawa ..... H02M 3/156 363/16
2002/0167350 A1 * 11/2002 Sato ..... G05F 1/465 327/540
2003/0178976 A1 * 9/2003 Xi ..... G05F 1/575 323/273
2005/0088856 A1 * 4/2005 Yamamoto ..... H02M 3/1588 363/19
2007/0018625 A1 * 1/2007 Aikawa ..... G05F 1/565 323/282
2007/0035183 A1 * 2/2007 Shimizu ..... H02J 9/061 307/126
2007/0046276 A1 * 3/2007 Taki ..... G05F 3/08 323/312
2010/0026250 A1 * 2/2010 Petty ..... H02M 3/156 323/271
2010/0123443 A1 * 5/2010 Grimm ..... H02M 3/156 323/282
2010/0127678 A1 * 5/2010 Inatomi ..... H02M 1/32 323/282
2010/0194201 A1 * 8/2010 Nozaki ..... H02J 1/08 307/80
2012/0206125 A1 * 8/2012 Apriletti ..... H02M 3/155 323/351
2014/0146238 A1 * 5/2014 Murakami ..... H04N 5/63 348/730
2015/0042300 A1 * 2/2015 Peker ..... H02M 3/1588 323/274
2015/0270774 A1 * 9/2015 Tamura ..... H02M 3/07 307/9.1
2017/0083034 A1 * 3/2017 Yang ..... G05F 1/575
2017/0279357 A1 * 9/2017 Tajima ..... H02M 3/158
2017/0293312 A1 * 10/2017 Hu ..... G05F 1/575
2018/0129234 A1 * 5/2018 Melgar ..... G05F 1/563
2019/0006842 A1 * 1/2019 Watanabe ..... H01L 27/0285
2019/0074820 A1 * 3/2019 Namai ..... H03K 3/037
2020/0292582 A1 * 9/2020 Suzuki ..... G01R 15/04

* cited by examiner

| | SW1 | SW2 | TR3 | TR2 | TR4 |
|---|---|---|---|---|---|
| Normal operation | On | On | On | Off | Off |
| Sleep operation | Off | Off | Off | On | On |

FIG. 3

POWER SUPPLY CIRCUIT ALTERNATELY SWITCHING BETWEEN NORMAL OPERATION AND SLEEP OPERATION

CROSS-REFERENCE TO RELATED APPLICATION

This application claims the benefit of Japan Application No. 2019-064415, filed on Mar. 28, 2019. The entirety of the above-mentioned patent application is hereby incorporated by reference herein and made a part of this specification.

BACKGROUND

Technical Field

The disclosure relates to a power supply circuit.

DESCRIPTION OF RELATED ART

The power supply circuit disclosed in Japanese Patent Laid-Open No. 2001-147746 (Patent Document 1) suppresses current consumption due to leakage using a switch.

In connection with suppression of the current consumption described above, for example, in a power supply circuit used in a wireless system, a normal operation and a sleep operation, in which only a minimum necessary operation is performed, are alternately switched in time series. In a power supply circuit, an output of a voltage of the power supply circuit to an output terminal is basically performed by a main low dropout (LDO) unit in a normal operation, and on the other hand, by a sub LDO unit in a sleep operation. More specifically about the former, as shown in FIG. 4, a main LDO unit 10 generates a second internal voltage Vin2 (for example, 1.4 V) from a first internal voltage Vin1 (for example, 1.7 V) generated by a direct current/direct current (DC/DC) converter unit (not shown) and outputs the second internal voltage Vin2 to an output terminal TM.

The main LDO unit 10 has a feedback system for stabilizing a level of the above-described second internal voltage Vin2 to be output during the normal operation. The feedback system is configured by an amplifier A10, a transistor TR10 (for example, a P-channel metal-oxide-semiconductor field-effect transistor (PMOSFET)), a switch SW10, and resistors R10 and R20. The amplifier A10 differentially amplifies a reference voltage Vref (for example, 1.2 V) output from a bias unit (not shown) and a divided voltage Vdiv (for example, around 1.2 V) defined by dividing the second internal voltage Vin2 by the resistors R1 and R2 and outputs a voltage Vg (gate voltage Vg) obtained by the differential amplification to a gate of the transistor TR10. In the main LDO unit 10, a source/drain current of the transistor TR10 is increased or decreased by raising or lowering the gate voltage Vg while referring to the reference voltage Vref. Thereby, the second internal voltage Vin2, which is a drain voltage of the transistor TR10, is stabilized at the above-described 1.4 V.

On the other hand, when the normal operation is switched to the sleep operation in response to a control signal CT, the DC/DC converter unit stops its operation in contrast to when the normal operation described above is performed. However, the first internal voltage Vin1 output by the DC/DC converter during the normal operation prior to the sleep mode and applied to the source and back gate of the transistor TR10 gradually decreases due to an influence of elements (for example, a smoothing capacitor) connected between an output end of the DC/DC converter and the ground. As a result, the first internal voltage Vin1 falls below an output voltage (sleep voltage) from a sub LDO unit (not shown) applied to the output terminal TM. That is, in the transistor TR10, the first internal voltage Vin1 applied to the source and the back gate is lower than the sleep voltage applied to the drain. Thereby, a forward voltage is applied to a body diode (not shown) of the transistor TR10, and as a result, there is a problem in that a leakage current in the transistor TR10 increases.

SUMMARY

In order to solve the above problem, a power supply circuit according to the disclosure is a power supply circuit which switches to a sleep operation following a normal operation and includes a sub LDO unit which generates a sleep voltage that is a voltage for the sleep operation and outputs the sleep voltage to an output terminal during the sleep operation, a PMOS transistor having a source connected to a first internal voltage and configured to output a second internal voltage, which is a voltage of a drain defined by control of a magnitude of a current flowing between the source and the drain, to the output terminal during the normal operation, and a main LDO unit in which a voltage higher than the sleep voltage is applied to the gate and a back gate of the PMOS transistor during the sleep operation.

BRIEF DESCRIPTION OF THE DRAWINGS

FIG. 3 shows a state of each part of the main LDO unit according to the embodiment.

DESCRIPTION OF THE EMBODIMENTS

The disclosure provides a power supply circuit in which an increase in a leakage current can be suppressed.

According to the power supply circuit of the disclosure, in the main LDO unit, during the sleep operation, although the sleep voltage from the sub LDO unit is applied to the drain of the PMOS transistor via the output terminal, a voltage higher than the sleep voltage is applied to the gate and the back gate of the PMOS transistor. Accordingly, since a reverse bias is applied to the body diode of the PMOS transistor, it is possible to avoid an increase in a leakage current in the PMOS transistor.

Embodiment

Hereinafter, a power supply circuit according to an embodiment of the disclosure will be described.

Configuration of Embodiment

Figure 1:
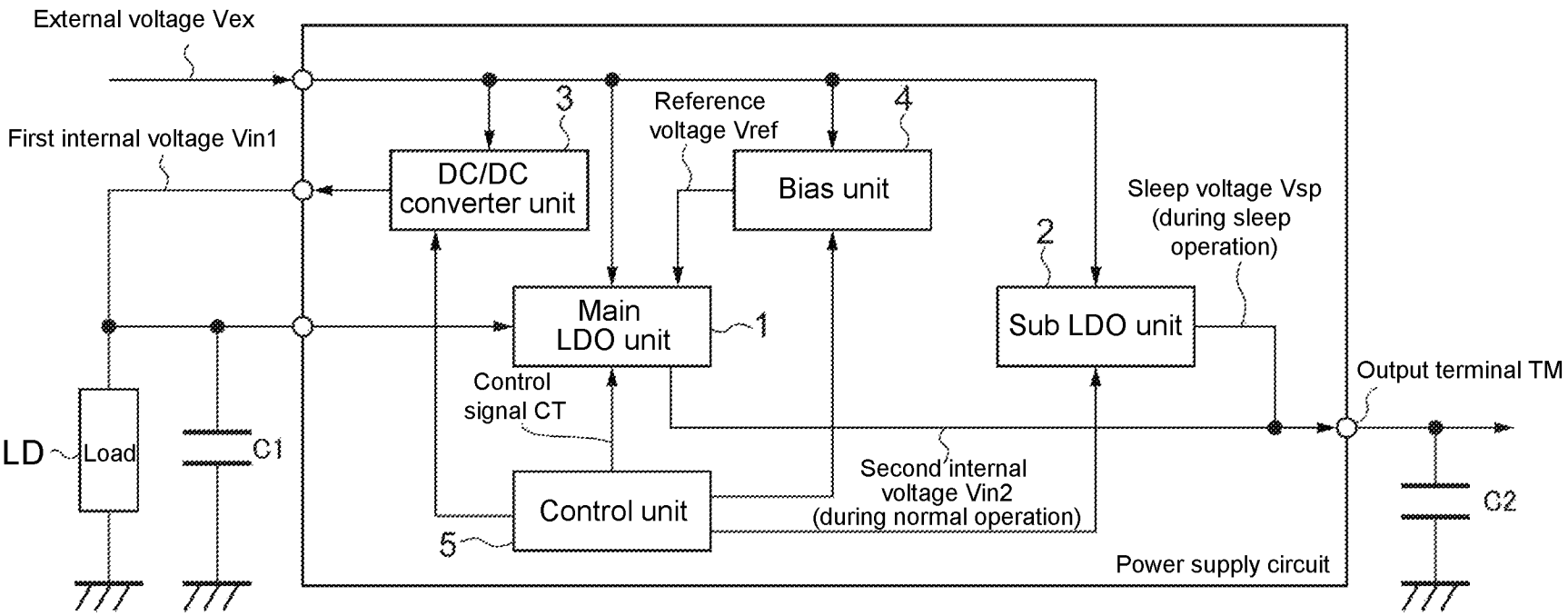
FIG. 1 shows a configuration of a power supply circuit according to an embodiment.

FIG. 1 shows a configuration of a power supply circuit according to an embodiment. Hereinafter, a power supply circuit according to the embodiment will be described with reference to FIG. 1.

As shown in FIG. 1, a power supply circuit PS of the embodiment receives an external voltage Vex (for example, 3.3 V), and on the other hand, outputs a first internal voltage Vin1 (for example, 1.7 V), a second internal voltage Vin2 (for example, 1.4 V), and a sleep voltage Vsp (for example, 1.4 V). The power supply circuit PS includes a main low dropout (LDO) unit 1, a sub LDO unit 2, a direct current/direct current (DC/DC) converter unit 3, a bias unit 4, and a control unit 5 to output the three voltages described above. In the power supply circuit PS, a normal operation and a sleep operation are alternately switched in time series to reduce power consumption. During the normal operation, the power supply circuit PS outputs the first internal voltage Vin1 and the second internal voltage Vin2 so that the power supply circuit PS and an external circuit (a circuit other than the power supply circuit PS) operate normally. On the other hand, during the sleep operation, the power supply circuit PS outputs only the sleep voltage Vsp to reduce power consumption.

The main LDO unit 1 has a function of low dropout (LDO), that is, a function as a linear regulator that receives an input voltage and generates an output voltage (for example, 1 V or less) lower than the input voltage.

During the normal operation, the main LDO unit 1 generates the second internal voltage Vin2 from the first internal voltage Vin1 output from the DC/DC converter unit 3 to exhibit the function of the LDO described above. The main LDO unit 1 outputs the generated second internal voltage Vin2 to an output terminal TM. The main LDO unit 1 performs generation of the second internal voltage Vin2 on the basis of a reference voltage Vref output from the bias unit 4.

On the other hand, during the sleep operation, the main LDO unit 1 does not generate the second internal voltage Vin2 in contrast to when the normal operation described above is performed and accordingly does not output any voltage to the output terminal TM.

Whether the main LDO unit 1 should operate in the normal operation or the sleep operation is determined by a control signal CT output from the control unit 5.

The sub LDO unit 2 has a function of the LDO similar to the main LDO unit 1, that is, a function as a linear regulator that receives an input voltage and generates an output voltage (for example, 1 V or less) lower than the input voltage. The sub LDO unit 2 performs an operation that stands in contrast to the main LDO unit 1.

During the sleep operation, the sub LDO unit 2 generates the sleep voltage Vsp from the external voltage Vex to exhibit the function of the LDO. The sub LDO unit 2 outputs the generated sleep voltage Vsp to the output terminal TM.

On the other hand, the sub LDO unit 2 does not substantially perform any operation during the normal operation, that is, it is in a warm standby mode, and in other words, it does not output any voltage to the output terminal TM.

Similarly to the main LDO unit 1, whether the sub LDO unit 2 should operate in the normal operation or the sleep operation is determined by the control signal CT output from the control unit 5.

The DC/DC converter unit 3 has a function of converting (step-down) one DC voltage to another DC voltage. Specifically, the DC/DC converter unit 3 generates the above-described first internal voltage Vin1 from the external voltage Vex. The DC/DC converter unit 3 outputs the generated first internal voltage Vin1 to an external circuit (corresponding to a load LD), and the first internal voltage Vin1 is also input to the main LDO unit 1 after being output through the external circuit.

The bias unit 4 outputs the above-described reference voltage Vref to the main LDO unit 1 to provide a reference when the main LDO unit 1 generates the second internal voltage Vin2 from the first internal voltage Vin1.

The control unit 5 outputs the control signal CT indicating which of the normal operation and the sleep operation is to be operated to the main LDO unit 1, the sub LDO unit 2, the DC/DC converter unit 3, and the bias unit 4. Here, the "control signal" does not simply mean a specific signal (for example, a digital signal) of, for example, 1 or 0, a high voltage or a low voltage, but means an abstract signal (conceptual signal) indicating which of the normal operation and the sleep operation is to be operated. When the control unit 5 outputs the control signal CT indicating that the operation should be performed in the normal operation, the main LDO unit 1, the DC/DC converter unit 3, and the bias unit 4 operate (the sub LDO unit 2 does not substantially operate). On the contrary, when the control unit 5 outputs the control signal CT indicating that the operation should be performed in the sleep operation, only the sub LDO unit 2 operates.

One or more external circuits (loads LDs) are connected to the first internal voltage Vin1 output from the power supply circuit PS having the above-described configuration. Also, a smoothing capacitor C1 is provided between an input end of the first internal voltage Vin1 and the ground in the power supply circuit PS to stabilize the first internal voltage Vin1. Further, a capacitance (not shown) may be caused by a wiring for routing the first internal voltage Vin1 around between external circuits (loads LDs).

As described above, from the output terminal TM of the power supply circuit PS, the second internal voltage Vin2 output from the main LDO unit 1 is output during the normal operation, and on the other hand, the sleep voltage Vsp output from the sub LDO unit 2 is output during the sleep operation. The second internal voltage Vin2 or the sleep voltage Vsp output from the output terminal TM is applied to an external circuit (regardless of whether it is the same as or different from the external circuit described above). Similarly to the function of the smoothing capacitor C1, a smoothing capacitor C2 is provided in the output terminal TM between the output terminal and the ground to stabilize the second internal voltage Vin2 and the sleep voltage Vsp.

Figure 2:
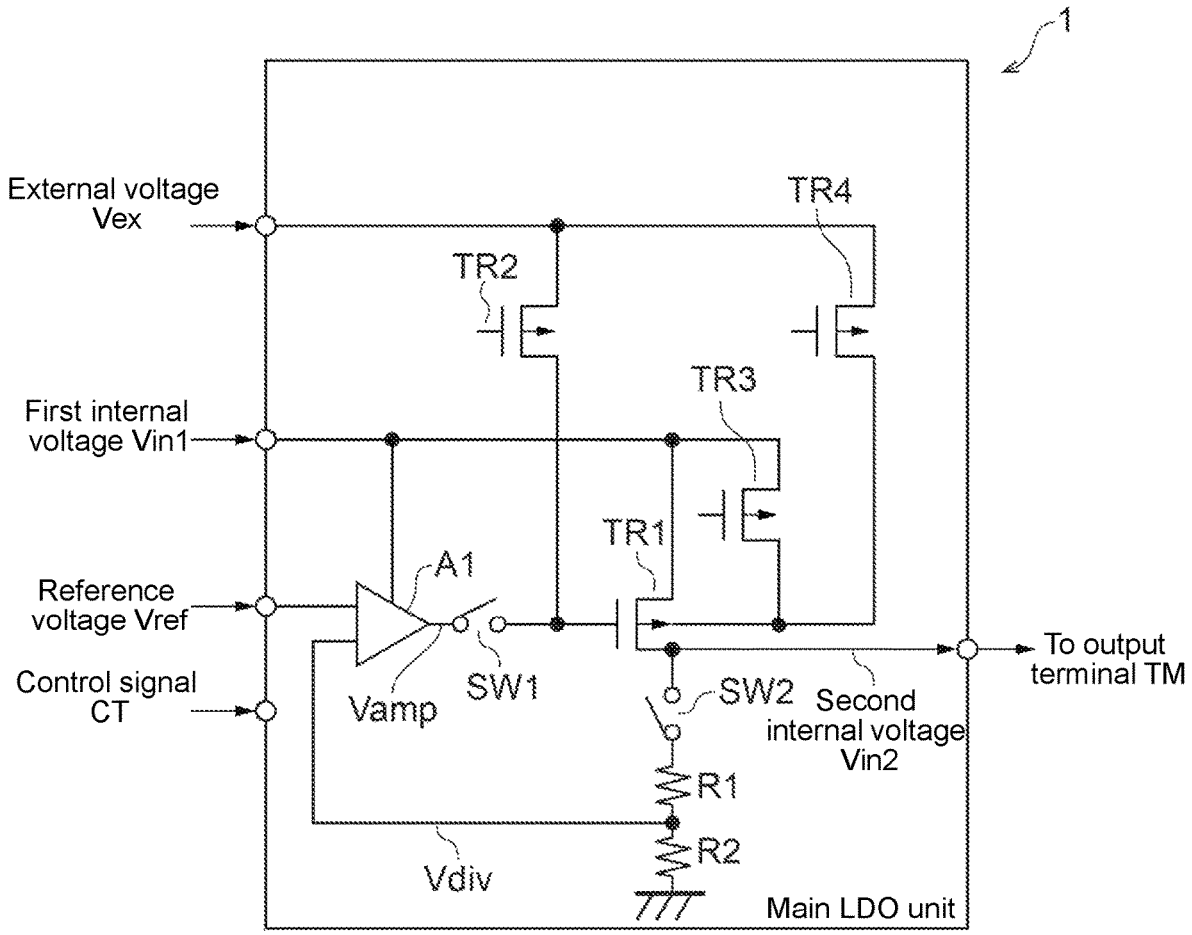
FIG. 2 shows a configuration of a main LDO unit of the embodiment.

FIG. 2 shows a configuration of a main LDO unit of the embodiment. Hereinafter, the main LDO unit of the embodiment will be described with reference to FIG. 2.

As shown in FIG. 2, the main LDO unit 1 includes an amplifier A1, transistors TR1, TR2, TR3, and TR4, which are P-channel metal-oxide-semiconductor field-effect transistors (PMOSFETs), switches SW1 and SW2, and resistors R1 and R2.

The amplifier A1 operates at the first internal voltage Vin1 and performs differential amplification. The amplifier A1 also includes two input terminals and one output terminal. The reference voltage Vref output from the bias unit 4 is input to one input terminal of the amplifier A1. A divided voltage Vdiv to be described below is input (fed back) to the other input terminal of the amplifier A1 to secure a feedback function. The amplifier A1 generates an amplified voltage Vamp by amplifying a voltage difference between the reference voltage Vref and the divided voltage Vdiv and outputs the amplified voltage Vamp from the output terminal.

The switch SW1 is provided at a subsequent stage of the amplifier A1. The switch SW1 has one end connected to an output terminal of the amplifier A1 and the other end connected to a gate of the transistor TR1 and a drain of the transistor TR2.

The transistor TR1 is provided at a subsequent stage of the switch SW1. In the transistor TR1, a source is connected to the first internal voltage Vin1, a drain is connected to the output terminal TM and one end of the switch SW2, and a back gate is connected to a drain of the transistor TR3 and a drain of the transistor TR4.

The other end of the switch SW2 is connected to one end of the resistor R1.

The resistors R1 and R2 are connected in series to divide the second internal voltage Vin2 output to the output terminal TM. The other end of the resistor R1 is connected to one end of the resistor R2, and the other end of the resistor R2 is connected to a ground potential. The second internal voltage Vin2 is divided by the resistors R1 and R2 connected in series, and thereby the above-described divided voltage Vdiv is defined at a connection point of the two resistors R1 and R2.

In the transistor TR2, the control signal CT is input to a gate, and a source is connected to the external voltage Vex.

In the transistor TR3, the control signal CT is input to a gate, and a source is connected to the first internal voltage Vin1.

In the transistor TR4, the control signal CT is input to a gate, and a source is connected to the external voltage Vex.

Operation of Embodiment

An operation of the main LDO unit of the embodiment will be described.

FIG. 3 shows a state of each part of the main LDO unit of the embodiment.

Hereinafter, an operation of the main LDO unit of the embodiment will be described with reference to FIGS. 2 and 3.

<During Normal Operation>

The main LDO unit 1 receives the control signal CT (shown in FIGS. 1 and 2) indicating that an operation should be performed in the normal operation from the control unit 5. In response to the control signal CT, in the main LDO unit 1, the transistors TR2 and TR4 enter an OFF state (cut-off state), and on the other hand, the transistor TR3 and the switches SW1 and SW2 enter an ON state (conductive state).

When the transistor TR2 is in the above-described cut-off state, the gate of the transistor TR1 is disconnected from the external voltage Vex, that is, the external voltage Vex is not applied to the gate of the transistor TR1. On the other hand, when the switch SW1 is in the above-described conductive state, the gate of the transistor TR1 is connected to the output terminal of the amplifier A1, that is, the amplified voltage Vamp output from the amplifier A1 is applied to the gate of the transistor TR1.

When the transistor TR4 is in the above-described cut-off state, the back gate of the transistor TR1 is disconnected from the external voltage Vex, that is, the external voltage Vex is not applied to the back gate of the transistor TR1. On the other hand, when the transistor TR3 is in the above-described conductive state, the back gate of the transistor TR1 is connected to the first internal voltage Vin1, that is, the first internal voltage Vin1 is applied to the back gate of the transistor TR1.

When the switch SW2 is in the above-described conductive state, a voltage at the drain of the transistor TR1 is divided by the resistors R1 and R2, and thereby the divided voltage Vdiv is defined at the connection point of the resistors R1 and R2. In the amplifier A1, the reference voltage Vref is input to one input terminal while the divided voltage Vdiv is input to the other input terminal. The amplifier A1 outputs the amplified voltage Vamp by amplifying a voltage difference between the reference voltage Vref and the divided voltage Vdiv.

In the transistor TR1, as described above, when the amplified voltage Vamp output from the amplifier A1 is applied to the gate, a source/drain current having a magnitude corresponding to a magnitude of the amplified voltage Vamp flows, in other words, the source/drain current increases or decreases according to a level (magnitude) of the amplified voltage Vamp. Due to the increase or decrease of the source/drain current, a variation of a voltage at the drain of the transistor TR1, that is, a variation of the second internal voltage Vin2, is suppressed. In this manner, the second internal voltage Vin2 whose variation has been suppressed, that is, the second internal voltage Vin2 that is stable, is output to the output terminal TM.

<During Sleep Operation>

The main LDO unit 1 receives the control signal CT (shown in FIGS. 1 and 2) indicating that an operation should be performed in a sleep mode from the control unit 5. On the contrary, in the main LDO unit 1 in the sleep operation, the transistors TR2 and TR4 enter an ON state (conductive state), and on the other hand, the transistor TR3 and the switches SW1 and SW2 enter an OFF state (cut-off state) in response to the control signal CT.

When the transistor TR2 is in the above-described conductive state, the gate of the transistor TR1 is connected to the external voltage Vex, that is, the external voltage Vex is applied to the gate of the transistor TR1. On the other hand, when the switch SW1 is in the above-described cut-off state, the gate of the transistor TR1 is disconnected from the output terminal of the amplifier A1, that is, the amplified voltage Vamp output from the amplifier A1 is not applied to the gate of the transistor TR1.

When the transistor TR4 is in the conductive state, the back gate of the transistor TR1 is connected to the external voltage Vex, that is, the external voltage Vex is applied to the back gate of the transistor TR1. On the other hand, when the transistor TR3 is in the cut-off state, the back gate of the transistor TR1 is disconnected from the first internal voltage Vin1, that is, the first internal voltage Vin1 is not applied to the back gate of the transistor TR1.

When the switch SW2 is in the above-described cut-off state, a voltage at the drain of the transistor TR1 is not divided by the resistors R1 and R2. As a result, the divided voltage Vdiv, which is the ground potential (potential of the ground connected to the other end of resistor R2), is input to the other input terminal of the amplifier A1. Here, as described above, since the switch SW1 is in the cut-off state, a magnitude of the divided voltage Vdiv input to the other input terminal does not affect an operation of the transistor TR1 at all.

Here, as for a relationship between the output terminal TM and the sub LDO unit 2, as described above, the sub LDO unit 2 outputs the sleep voltage Vsp to the output terminal TM during the sleep operation. Therefore, the sleep voltage Vsp is applied to the output terminal TM, and in other words, the sleep voltage Vsp is applied to the drain of the transistor TR1.

The above-described voltages applied to the transistor TR1 during the sleep operation are summarized as follows. (1) The first internal voltage Vin1 is applied to the source, (2) the external voltage Vex is applied to the gate and the back gate, and (3) the sleep voltage Vsp is applied to the drain.

The external voltage Vex higher than the first internal voltage Vin1 applied to the source is applied to the gate, and in other words, a reverse bias that causes the transistor TR1 to be in an OFF state (cut-off state) is applied between the gate and the source. Thereby, the transistor TR1 becomes a cut-off state that is, the drain is open (open end) in relation to the source.

Also, since the external voltage Vex higher than the sleep voltage Vsp applied to the drain and higher than the first internal voltage Vin1 applied to the source is applied to the back gate, a body diode (not shown) of the transistor TR1 is in an OFF state (cut-off state).

Effects of Embodiment

Figure 4:
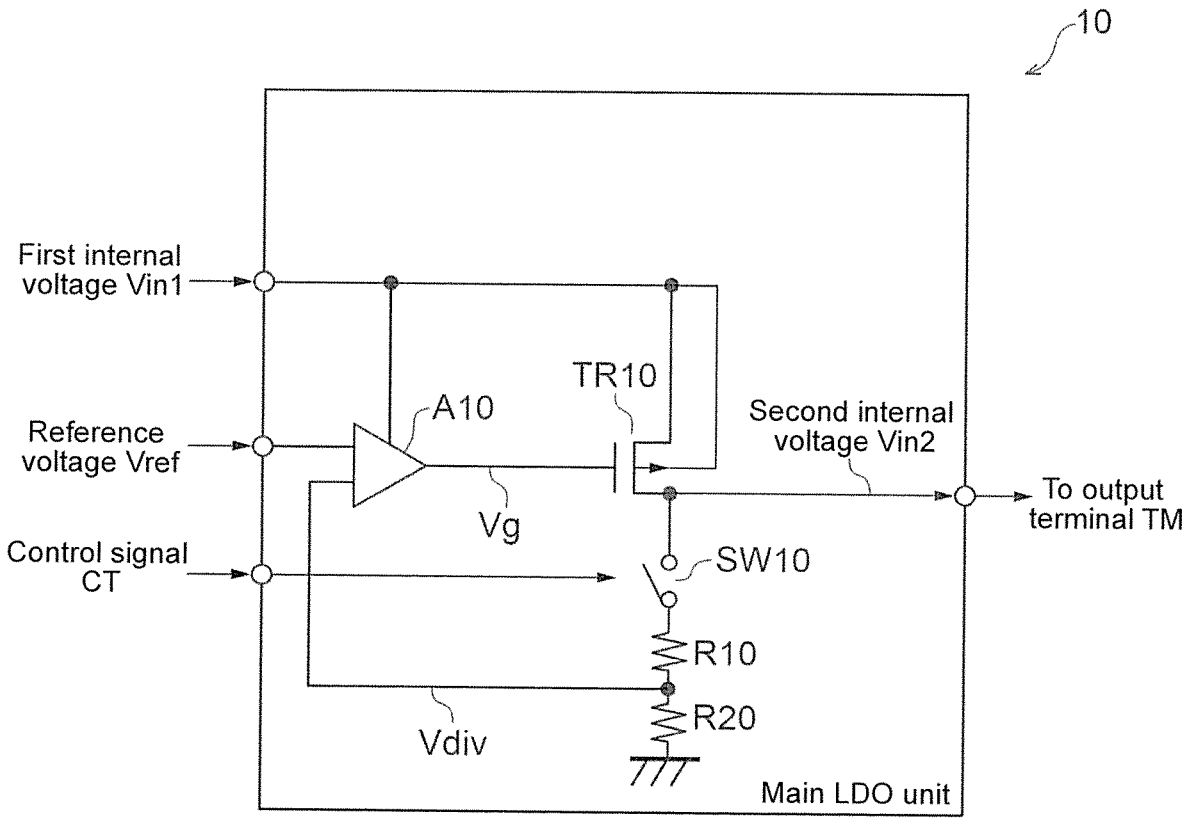
FIG. 4 (Prior Art)
FIG. 4 shows a configuration of a conventional main LDO unit.

As described above, in the main LDO unit of the embodiment, during the sleep operation, the external voltage Vex higher than the first internal voltage Vin1 and the sleep voltage Vsp is applied to the gate and the back gate of the transistor TR1 in which the first internal voltage Vin1 is applied to the source and the sleep voltage Vsp is applied to the drain. Thereby, the transistor TR1 is in a cut-off state, and the body diode of the transistor TR1 is in a cut-off state. Due to the latter cut-off state of the body diode, the first internal voltage Vin1 gradually decreases, causing the body diode to enter a conductive state unlike that which is illustrated in FIG. 4, and thereby a situation in which a leakage current flows through the transistor TR1 can be avoided.

Modified Example

Instead of using PMOSFETs for the transistors TR1 to TR4 in the main LDO unit 1 of the above-described embodiment, it is also possible to use N-channel metal-oxide-semiconductor field-effect transistors (NMOSFETs). When NMOSFETs are used, an ON state and an OFF state of the transistors TR2 to TR4 and the switches SW1 and SW2 in the normal operation and the sleep operation are the same as those in the case shown in FIG. 3 in which PMOSFETs are used.

On the other hand, when NMOSFETs are used, a voltage applied to the transistor TR1 during the sleep operation is different from that of the above-described embodiment. Specifically, unlike a high-side drive using the PMOSFETs in the above-described embodiment, assuming a low-side drive using the NMOSFETs, a voltage (first voltage) lower than the sleep voltage Vsp applied to the source needs to be applied to the drain of the transistor TR1, and a voltage (second voltage) lower than the sleep voltage Vsp applied to the source and lower than the first voltage applied to the drain needs to be applied to the gate and the back gate. Thereby, both the transistor TR1 and the body diode can be made to be in a cut-off state as in the case of using the PMOSFETs.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A power supply circuit which switches to a sleep operation following a normal operation, the power supply circuit comprising;

a sub low dropout (LDO) unit which generates a sleep voltage that is a voltage for the sleep operation and outputs the sleep voltage to an output terminal during the sleep operation; and a main LDO unit, comprising:

a first PMOS transistor having a source connected to a first internal voltage and having a drain connected to the output terminal, and configured to output a second internal voltage, which is a voltage of the drain defined by control of a magnitude of a current flowing between the source and the drain according to a magnitude of a voltage applied to a gate, to the output terminal during the normal operation, wherein another voltage higher than the sleep voltage applied to the drain and higher than the first internal voltage applied to the source is applied to the gate and a back gate of the first PMOS transistor to turn a body diode of the first PMOS transistor into a cut-off state during the sleep operation.

2. The power supply unit according to claim 1, further comprising:

a second PMOS transistor having a source connected to the another voltage and a drain connected to the gate of the first PMOS transistor;

a third PMOS transistor having a source connected to the first internal voltage and a drain connected to the back gate of the first PMOS transistor; and a fourth PMOS transistor having a source connected to the another voltage and a drain connected to the back gate of the first PMOS transistor, wherein, during the normal operation, the third PMOS transistor is in a conductive state, and the second PMOS transistor and the fourth PMOS transistor are in a cut-off state, and during the sleep operation, the third PMOS transistor is in a cut-off state and the second PMOS transistor and the fourth PMOS transistor are in a conductive state.

* * * * *